US005639421A

United States Patent [19]

Ichikawa et al.

[11] Patent Number: 5,639,421

[45] Date of Patent: Jun. 17, 1997

[54] HIGH-HARDNESS PRECIPITATION HARDENING STEEL FOR METALLIC MOLD

[75] Inventors: Jiro Ichikawa, Chita; Toshihiro Kitagawa, Nagoya, both of Japan

[73] Assignee: Daido Tokushuko Kabushhiki Kaisha, Nagoya, Japan

[21] Appl. No.: 541,978

[22] Filed: Oct. 10, 1995

[51] Int. Cl.[6] ..... C22C 38/42; C22C 38/06

[52] U.S. Cl. ..... 420/87; 420/108

[58] Field of Search ..... 420/87, 108; 148/335

[56] References Cited

U.S. PATENT DOCUMENTS

| | | | |
|---|---|---|---|
| 5,013,524 | 5/1991 | Leban | 420/87 |
| 5,023,049 | 6/1991 | Norström et al. | 420/108 |
| 5,447,800 | 9/1995 | Dorsch et al. | 420/87 |

FOREIGN PATENT DOCUMENTS 55-28384 2/1980 Japan .

*Primary Examiner*—Deborah Yee

*Attorney, Agent, or Firm*—Sughrue, Mion, Zinn, Macpeak & Seas

[57] ABSTRACT

A precipitation hardening steel excellent in machinability, toughness (10J/cm$^2$ or above), hardness (HRC43 or above) after aging treatment and suitable to a metallic mold for plastics, which consists by weight percentage of C: 0.05–0.18%, Si:0.15–1.00%, Mn:1.0–2.0%, Ni:2.5–3.5%, Cr:0.7–2.0%, Al:0.5–1.5%, Cu:0.7–1.7%, Mo:0.1–0.4%, S:0.05–0.35%, and the balannce of Fe, and H-value obtained through the following equation indicates zero or a positive value:

$$H=(3.843\ Mn+4.378\ Cr^{0.58})-(4.220\ S+8.193)$$

10 Claims, 4 Drawing Sheets

HIGH-HARDNESS PRECIPITATION HARDENING STEEL FOR METALLIC MOLD

BACKGROUND OF THE INVENTION

1. Field of the Invention

This invention relates to a high-hardness precipitation hardening steel suitable to a material for a metallic mold to be used for forming of plastics (synthetic resin), for example, which is required to surpass in specular gloss.

2. Description of the Prior Art

Heretofore, carbon steels and low-alloy steels have been widely used as a material for a metallic mold used for forming plastics.

In the metallic mold for forming plastics, a pattern is formed on an inner surface of the metallic mold through photoetching to transfer the pattern on moldings.

In this case, it is required for performing photoetching uniformly on the metallic mold in order to transferably form the pattern on the moldings finely and neatly.

However, in the conventional steels such as carbon steels and low-alloy steels, there is a problem in that it is practically difficult to perform uniform photoetching since structure and hardness of the steel become discontinuous among weld metal, heat-affected zone and base metal when the photoetching is performed after padding.

As a die steel which is possible to solve the aforementioned problem, a precipitation hardeness steel of Mn-Ni-Al-Cu-Mo-Fe system is disclosed in Japanese Patent Disclosure (KOKAI) No. 55-28384/80.

In this steel, it is possible to minimize the variation of the hardness among the weld metal, the heat-affected zone and the base metal, therefore possible to perform the photoetching uniformly.

The metallic mold causes a flash or burr of the moldings at a portion between die faces when a depression is formed on the die face of the metallic mold by abrasion or bite of the plastic material between the die faces, and such the problem becomes serious especially in the recent situation where harder plastic materials including filler materials or so become to be used. Accordingly, there is a problem since it is not possible to respond sufficiently to the demand for extending life-time of the metallic mold.

SUMMARY OF THE INVENTION

This invention is made in the aforementioned situation for the purpose of providing a high-hardeness precipitation hardening steel which is possible to be used suitably as a material for a metallic mold required for the long service life and is provided with the other properties required as the metallic mold to be used for forming plastics.

That is, the high-hardeness precipitation hardening steel for the metallic mold according to this invention is characterized by consisting essentially by weight percentage of from 0.05 to 0.18% of C, from 0.15 to 1.00% of Si, from 1.0 to 2.0% of Mn, from 2.5 to 3.5% of Ni, from 0.7 to 2.0% of Cr, from 0.5 to 1.5% of Al, from 0.7 to 1.7% of Cu, from 0.1 to 0.4% of Mo, from 0.05 to 0.35% of S, and the balance being Fe and inevitable impurities, and having hardness of not lower than HRC43 after aging treatment and impact value of not lower than 10 J/cm$^2$ by 2 mm U-notch charpy impact test, wherein H-value calculated using the following equation indicates zero or a positive value: $H=(3.843\ Mn+4.378\ Cr^{0.58})-(4.220\ S+8.193)$.

The high-hardeness precipitation hardening steel for the metallic mold according to the first embodiment of this invention is characterized in that the steel contains from 0.05 to 0.20% of S, and the impact value is not lower than 25 J/cm$^2$.

The high-hardeness precipitation hardening steel for the metallic mold according to the second embodiment of this invention is characterized in that a ratio of average length/average diameter corresponding to circle of sulfides observed on a section of the steel is not lower than 1.7.

The high-hardeness precipitation hardening steel for the metallic mold according to the third embodiment of this invention is characterized in that the steel contains from 0.20 to 0.35% of S.

Furthermore, the high-hardeness precipitation hardening steel for the metallic mold according to the fourth embodiment of this invention is characterized in that the metallic mold is to be used for forming plastics required to surpass in specular gloss.

DATAILED DESCRIPTION OF THE INVENTION

Figure 1:
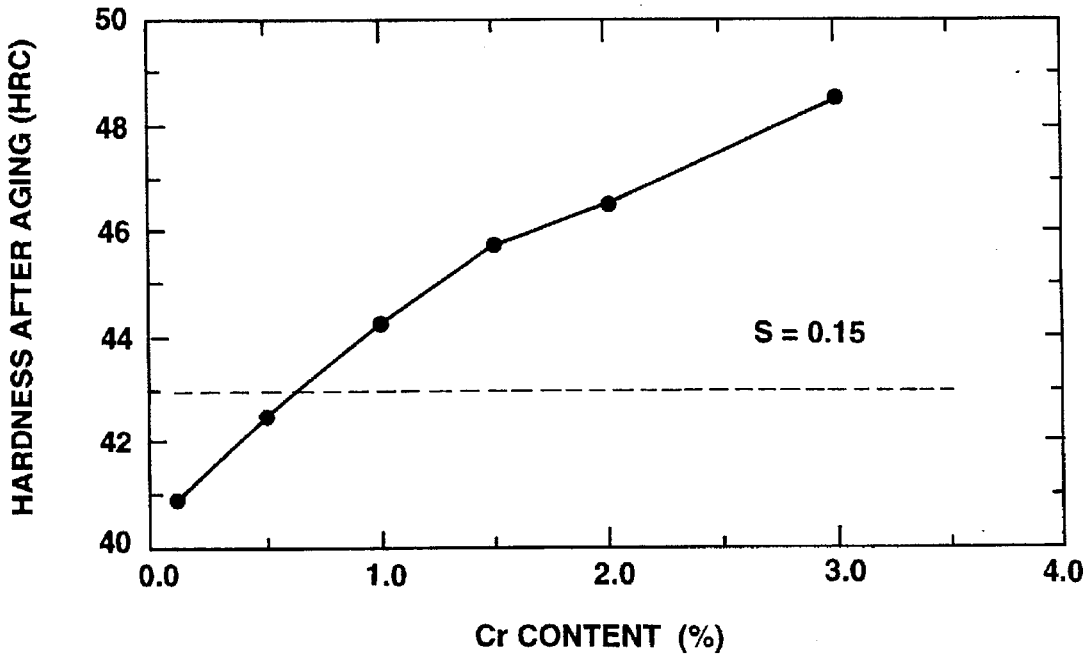
FIG. 1 is a graph illustrating relationship between Cr content and hardness after aging obtained through examples according to this invention.

In the metallic mold for forming plastics (synthetic resin), it has been known that it is effective to increase its hardness in order to extend the life-time of the metallic mold.

However, if the hardness of the metallic mold is increased, the toughness (charpy impact value) is lowered antinomically. The charpy impact value is one of the most important properties of steels to be used as materials for the metallic mold, for example, metallic injection mold for plastics.

In recent years, automation and high-speed operation are earnestly requested in the forming of plastics. In order to realize the high-speed operation, it is important to increase the speed at the time of die matching and die clamping of the metallic mold. In this time, if the metallic mold is brittle, that is not excellent in the toughness (charpy impact value), a problem arises in that the metallic mold may be partially broken at the time of die matching at the high-speed, and the fatigue life of the metallic mold may be shortened.

Therefore, it is necessary to improve the charpy impact value of the metallic mold in order to increase the forming speed of plastics.

Furthermore, the charpy impact value of the metallic mold has a significant meaning in order to prevent breaks at a conner or so of the metallic mold at the time of handling the metallic mold, namely, fitting of the metallic mold to a forming machine, removing of the metallic mold from this, storing of the metallic mold and so on.

In addition to above, good machinability is also required as a material for the metallic mold to be used for forming plastics.

As a general method for improving the machinability of steels, it is well known to increase S content in the steel, however the charpy impact value is deteriorated if the S content is simply increased. Namely, the machinability and the hardness are generally incompatible properties with the toughness (charpy impact value).

The conventional material provided for the metallic mold for forming plastics is low in the hardness, therefore it is not always clarified that how hardness is required for obtaining the long service life enough in practical application of the metallic mold, and what balance is required among the hardness, the machinability and the charpy impact value in order to ensure these properties at the same time, which are incompatible with each other.

The inventors have abtained characteristic results from a study on the hardness, the machinability, the toughness and the balance among them that the hardness and the charpy impact value possible to be obtained at the same time are HRC43 and 25 J/cm$^2$ or above respectively, whrerby it is possible to extend the life-time of the metallic mold up to the level desirable in practical application and possible to increase the forming speed of plastics, therefore this invention has been accomplished.

As a results of detailed investigation concerning relation between Cr content and properties of the steel in the study for realize the steel with the hardness of not lower than HRC43 and charpy impact value of not lower than 25 J/cm$^2$, the inventers have found that the hardness of the steel after aging is improved by increasing the Cr content in the steel and the toughness is also improved together with the hardness up to certain degree of the Cr content in the steel of composition system containing C, Si, Mn, Ni, Al, Cu, Mo and S in the aforementioned ranges, and it is necessary to add Cr of not less than 0.7% in order to obtain the hardness of not lower than HRC43, furthermore the improved toughness turns into lowering when the Cr content exceeds 2.0%.

Additionally, as a result of the reserch concerning the relation between the S content and properties of the steel, it has become clear that the charpy impact value is rather improved by containing S within a certain range in the coexistence of Cr of from 0.7 to 2.0% nevertheless the charpy impact value is generally lowered by increasing the S content, and the range of S content effective to improve the charpy impact value is up to 0.2% or so.

Furthermore, it has been confirmed that it is necessary that there is specific relation among Mn, Cr and S content in the steel in order to obtain the hardness not lower than HRC43, namely it is required that the formula: $(3.843\ Mn+4.378\ Cr^{0.58})-(4.220\ S\ 8.193)\geqq 0$ is satisfied by the Mn, Cr and S content.

The present invention is completed on basis of the aforementioned findings, according to this invention it is possible to effectively extend the life-time of the metallic mold made from the precipitation hardening steel possible to be subjected to photoetching uniformly, and possible to realize the high-speed operation in the forming of plastics.

The precipitation hardening steel according to the other embodiment of this invention is so designed as to further improve the machinability by increasing the S content into a range of 0.20 to 0.35% at the same time of ensuring the hardeness of not lower than HRC43 and the charpy impact value in the level equal to that of conventional steels of not lower than 10 J/cm$^2$.

The inventors have obtained information as a result of investigation for the effect of form of sulfides on the machinability of the precipitation hardening steel that it is possible to more effectively improve the machinability when a ratio of average length/average diameter corresponding to circle of sulfides observed on a section is not lower than 1.7, and have achieved this invention.

According to this embodiment of this invention, it is possible to ensure the charpy impact value higher than a certain degree and possible to obtain the precipitation hardening steel with high-hardness and high-machinability.

The reason why the respective chemical composition of the precipitation hardening steel according to this invention is limited will be described below in detail.

C: 0.05 to 0.18 wt %

C is necessary to be added not less than 0.05% in order to obtain the hardeness and the strength of the steel, however the hot workability in a solution treated state and the machinability is damaged, and the toughness after aging treatment is deteriorated when the C content is increased more than 0.18% Therefore, the C content is defined in a range of 0.05 to 0.18%.

Si: 0.15 to 1.00 wt %

Si is added in order to control the hardness at the solution treated state together with Mn in a range of 0.15 to 1.00% so as not to damage the ductility and the toughness after aging treatment because Mn in single is not possible to control the hardness at the solution treated state in a case where the steel is large in mass.

Mn: 1.0 to 2.0 wt %

Mn is effective to improve hardenability of the steel at the time of cooling from the solution temperature and to increase the hardness after aging treatment together with C. It is necessary to add Mn of not less than 1.0% in order to ensure the hardness of higher than HRC43 after aging treatment, but the machinability and the toughness are damaged if Mn is added more than 2.0%. Therefore, the Mn content is defined in a range of 1.0 to 2.0%.

Ni: 2.5 to 3.5 wt %

Ni prevents "red shortness" at the hot working by forming homogenous solid solution between a part of Ni and Cu, and forms $\epsilon$-phase, which works as a nucleus at the time of precipitation of NiAl phase in the aging treatment, together with Cu in the solution state. Furthermore, Ni is an indispensable element for forming $\alpha'$-phase together with Al in the aging treated state.

Addition to above, it is necessary to add Ni in a range of 2.5 to 3.5% in order to also ensure photoetchability.

Cr: 0.7 to 2.0 wt %

It is necessary to add Cr of not less than 0.7% in order to ensure the hardness of not lower than HRC43 after aging treatment and to improve the charpy impact value.

However, the charpy impact value is lowered by adding Cr more than 2.0%, so that the upper limit is defined as 2.0%.

Al: 0.5 to 1.5 wt %

Al is an indispensable element for forming NiAl phase together with Ni in the aging treated state, and it is necessary to add Al of not less than 0.5% in order to ensure photoetchability. However, excessive addition of Al hurts workability, specular gloss, the ductility and the toughness, so that the upper limit of Al is defined as 1.5%.

Cu: 0.7 to 1.7 wt %

Cu has an important role as a nucleus for precipitating $\alpha'$-phase in the aging treatment, and is more effective especially in a case where Ni and Al content are low. Cu is an essential alloying element for improving the notch toughness by hot working.

Although it is necessary to add Cu of not less than 0.7% since Cu is effective to improve the machinability at the solution treated state, excessive addition of Cu more than 1.7% is unfavorable in view of hot brittleness and economical efficiency. Therefore, it is necessary to limit the Cu content in a range of 0.7 to 1.7%.

Mo: 0.1 to 0.4 wt %

Mo is an indispensable element for ensuring high toughness and excellent photoetchability, and required for adding not less than 0.1%.

However, when Mo is added more than 0.4%, uniformity in photoetching is damaged and the cost becomes higher, accordingly the upper limit is defined as 0.4%.

S: 0.05 to 0.35 wt %

In order to improve the machinability of the steel, S is necessary to be added not less than 0.05%.

Usually, if the S content is increased, the charpy impact value shows a tendency to drop as compared that the machinability is improved by increasing the S content, however the charpy impact value is improved by addition of S rather than a case of S-free in the steel according to this invention having the composition system in which Cr of 0.7 to 2.0% exists together with S.

However, the charpy impact value turns into a lowering tendency when the S content exceeds 0.20%. Accordingly, it is necessary to limit the S content in a range of 0.05 to 0.20 in order to ensure the charpy impact value on a higher level (25 J/cm$^2$ or above).

The S content may be also increased in a range of 0.20 to 0.35% in order to obtain the machinability on a higher level at a somewhat deterioration of the charpy impact value. Namely, the hot workability is not deteriorated even if the S content is increased up to 0.35% in the existence of Cr in the range of 0.7 to 2.0%, and it is possible to ensure the charpy impact value of the certain level (10 J/cm$^2$ or above) as compared with addition in a case of Cr-free.

With respect to the S content, it is necessary that H-value calculated using the following equation indicates zero or a positive value in order to obtain the hardness higher than HRC43 after aging treatment in this invention: $H=(3.843\ Mn+4.378\ Cr^{0.58})-(4.2205+8.193)$.

Ratio of average length/average diameter of sulfides$\geqq$1.7

It is confirmed that the form of sulfides has remarkable effect on the machinability of the steel having the aforementioned composition system. The machinability is improved desirably when the ratio of average length/average diameter corresponding to circle of sulfides is not lower than 1.7, so that the lower limit of the aforementioned ratio is defined as 1.7.

EXAMPLE 1

Next, the invention will be described in detail on the basis of following examples.

Respective steels having common base compositions of 0.12% C—0.3% Si—1.6% Mn—1% Cu—3.2% Ni—0.3% Mo—1.0% Al but different in S and Cr content from each other were melted in a vacuum induction furnace, and cast into respective ingots. The obtained ingots were heated at 1200° C. and then subjected to hot forging to form steel rods of 30–200 mm in diameter.

The steel rods were subjected to the solution treatment (cooling in air blast after heating at 900° C. for 2 hours), successively were subjected to the aging treatment (cooling in air after heating at 500° C. for 5 hours), and then the respective characteristics of the aging treated steel rods were evaluated. Results are shown in FIG. 1 to FIG. 4.

Figure 2:
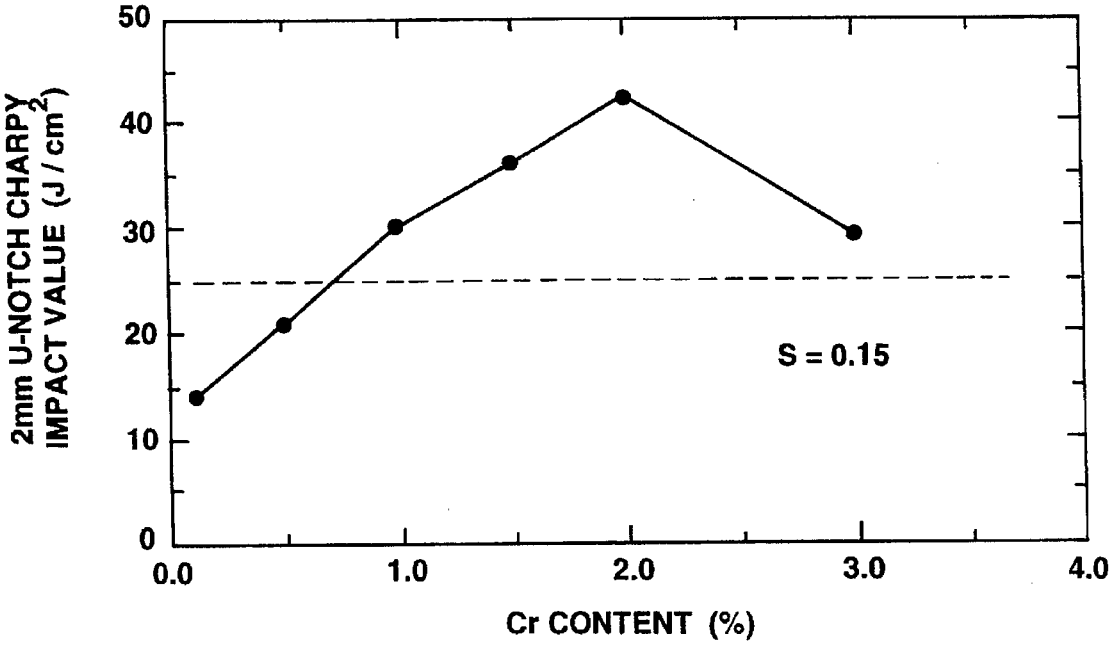
FIG. 2 is a graph illustrating relationship between Cr content and charpy impact value obtained through the examples according to this invention.

FIG. 1 is a graph illustrating relationship between the Cr content (abscissa) and the hardness after aging (ordinate), and FIG. 2 is a graph showing relationship between the Cr content (abscissa) and the charpy impact value (ordinate).

From the results, it is seen that it is possible to obtain the hardness of not lower than HRC43 and the charpy impact value of not lower than 25 J/cm$^2$ after aging treatment when the Cr content is 0.7% or more, the charpy impact value is improved along with increase of the Cr content and turns into a lowering tendency when the Cr content exceeds 2.0%.

Figure 3:
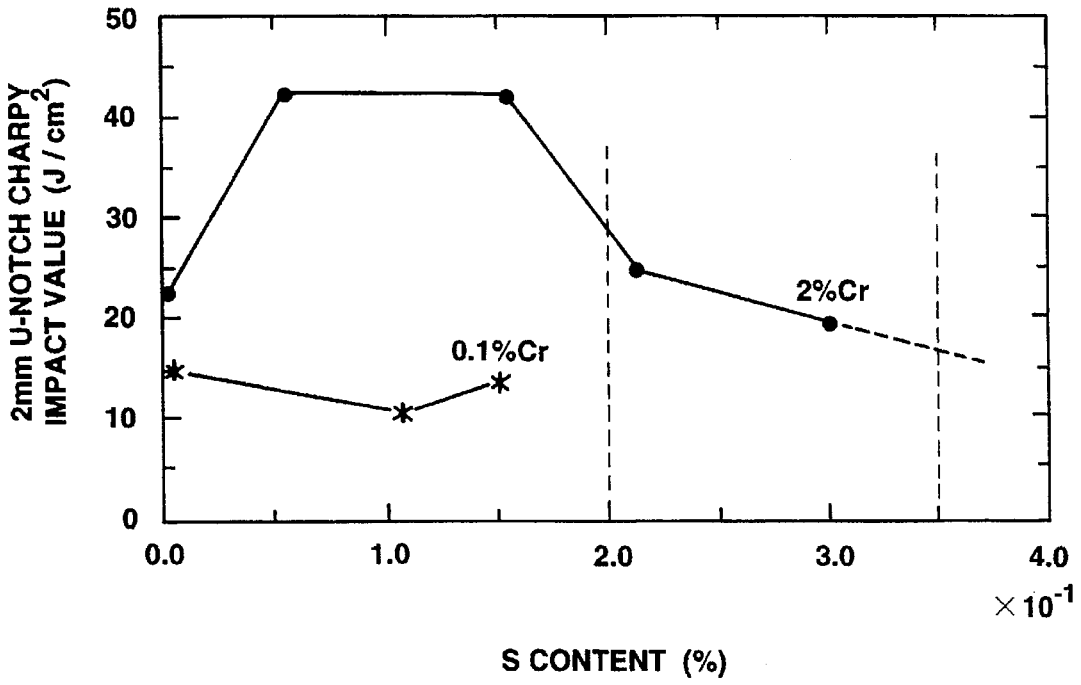
FIG. 3 is a graph illustrating relationship between S content and charpy impact value obtained through the examples according to this invention.

FIG. 3 is a graph showing relationship between the S content and the charpy impact value. From the graph, it is seen that the charpy impact value is rather improved by adding S under coexistence of 2% Cr, but the charpy impact value shows a tendency to drop when the S content exceeds 0.2% or so, however it is possible to ensure the charpy impact value of not lower than certain value (10 J/cm$^2$) under coexistence of 2% Cr even if the S content is increased up to 0.35%.

Figure 4:
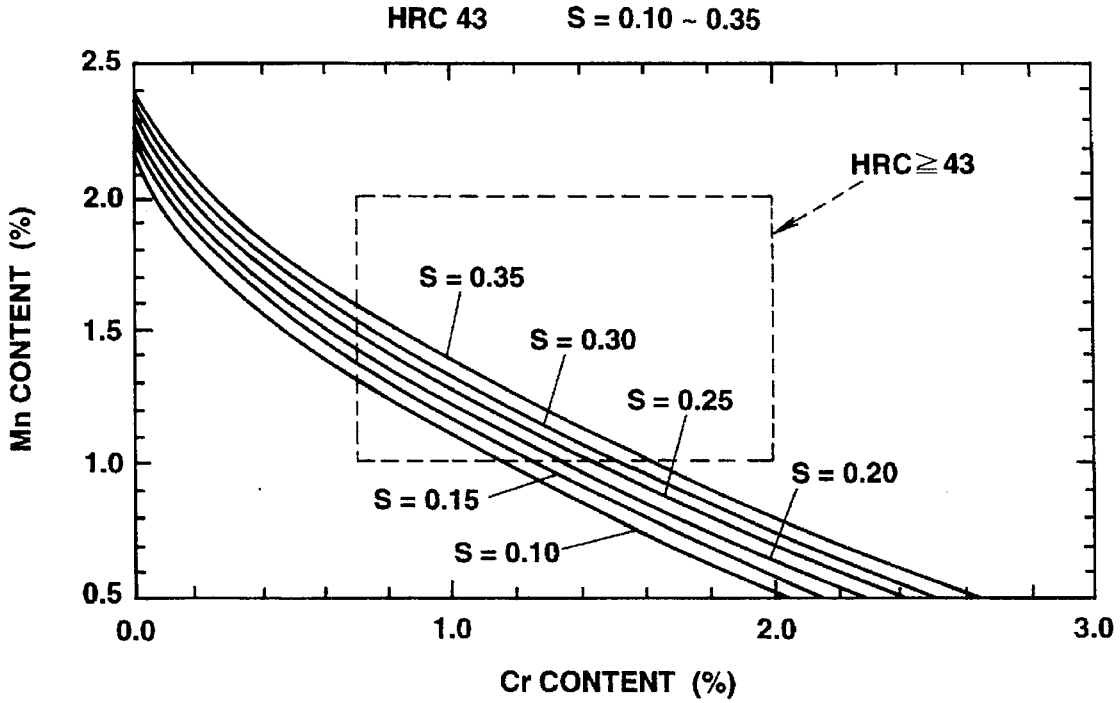
FIG. 4 is a graph illustrating effect of S, Mn and Cr content on the hardness after aging obtained through the examples according to this invention.

FIG. 4 is a graph showing effect of S, Mn and Cr content on the hardness after aging treatment. From the results, it is clear that it is necessary to control the S content less than a certain limit which is obtained in relation to the Mn and Cr content, in order to increase the hardness after aging treatment.

Therefore, it is confirmed that the S content required to obtain the hardness higher than HRC43 after aging treatment is necessary to have a connection with the Mn and Cr content expressed by the following formula: $(3.843\ Mn+4.378\ Cr^{0.58})-(4.220\ S+8.193)\geqq 0$.

Figure 5:
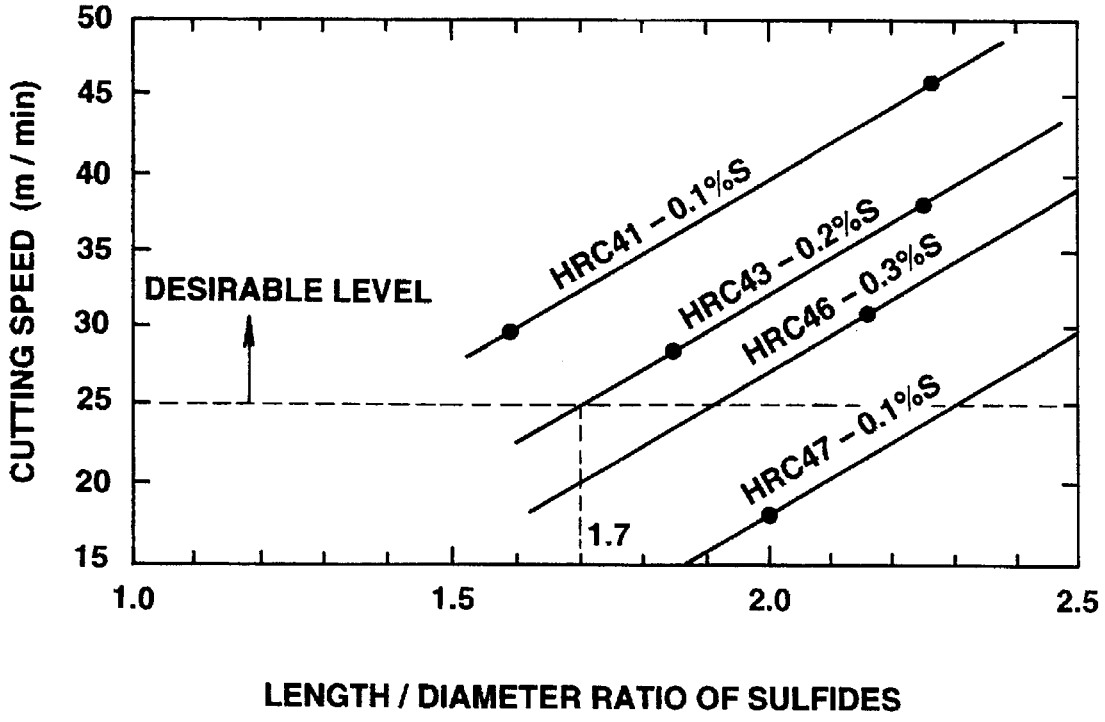
FIG. 5 is a graph illustrating relationship between a ratio of average length/average diameter corresponding to circle of sulfides and machinability obtained through the examples according to this invention.

FIG. 5 is a graph showing relationship between a ratio of average length/average diameter corresponding to circle of sulfides and the machinability in a case of varying the S content and the hardness after aging treatment. From the results, it is seen that the machinability is improved according as the aforementioned ratio becomes larger and it is possible to ensure the preferable machinability and the target hardness of not lower than HRC43 when the ratio is 1.7 or above.

Additionally, in the graph of FIG. 5, the machinability was evaluated through the following drill cutting test.

<Drill Cutting Test>

A hole of 15 mm depth was made in the respective steels using a straight shank drill of 5 mm in diameter under following conditions. Then the cutting speed at the time of making 67 holes (drilling length: 1000 mm) were evaluated as a scale of the machinability.

drill: SKH51 (high speed tool steel specified in JIS G 4403)

lubrication: not applied cutting speed: 10–50 m/min.

feed speed: 0.07 m/rev.

EXAMPLE 2

Steels of 11 kinds according to this invention and steels of 3 kinds according to comparative example having chemical compositions as shown in table 1 were respectively melted in the vacuum induction furnace, and cast into respective ingots. The ingots were heated at 1200° C. and then subjected to hot forging to form steel rods similarly to the above-mentioned Example 1.

TABLE 1

| Steel No. | Chemical composition (wt %) C | Si | Mn | S | Cu | Ni | Cr | Mo | Al | H-value |
|---|---|---|---|---|---|---|---|---|---|---|
| Invention sheets | | | | | | | | | | |
| A | 0.13 | 0.29 | 1.55 | 0.148 | 0.95 | 3.18 | 1.02 | 0.27 | 0.98 | 1.567 |
| B | 0.13 | 0.24 | 1.64 | 0.153 | 1.05 | 3.21 | 1.53 | 0.32 | 1.04 | 3.066 |
| C | 0.12 | 0.27 | 1.63 | 0.144 | 1.11 | 3.15 | 1.94 | 0.31 | 1.00 | 3.893 |
| D | 0.13 | 0.30 | 1.58 | 0.156 | 1.02 | 3.22 | 0.74 | 0.30 | 1.02 | 0.897 |
| E | 0.06 | 0.89 | 1.93 | 0.192 | 1.11 | 2.57 | 0,95 | 0.14 | 1.38 | 2.663 |
| F | 0.16 | 0.64 | 1.25 | 0.192 | 0.76 | 3.48 | 0.95 | 0.33 | 1.46 | 0.050 |
| G | 0.09 | 0.45 | 1.15 | 0.293 | 1.58 | 2.75 | 1.92 | 0.18 | 0.59 | 1.381 |
| H | 0.15 | 0.14 | 1.65 | 0.344 | 1.65 | 3.38 | 1.99 | 0.38 | 1.34 | 3.221 |
| I | 0.14 | 0.25 | 1.62 | 0.053 | 0.98 | 3.18 | 1.89 | 0.30 | 0.89 | 4.142 |
| J | 0.12 | 0.29 | 1.63 | 0.144 | 1.05 | 3.25 | 1.98 | 0.31 | 1.02 | 3.969 |
| K | 0.14 | 0.24 | 1.59 | 0.213 | 1.04 | 3.22 | 1.85 | 0.33 | 1.05 | 3.273 |
| Comparative steels | | | | | | | | | | |
| 1 | 0.13 | 0.35 | 1.61 | 0.155 | 1.02 | 3.23 | 0.01 | 0.33 | 0.97 | −2.356 |
| 2 | 0.14 | 0.33 | 1.58 | 0.152 | 0.98 | 3.24 | 0.51 | 0.28 | 1.03 | 0.200 |
| 3 | 0.13 | 0.31 | 1.58 | 0.011 | 0.99 | 3.21 | 1.94 | 0.25 | 0.98 | 4.262 |

The obtained steel rods were subjected to the solution treatment, successively subjected to the aging treatment in the same manner as the Example 1.

Then the hardness and the charpy impact value were evaluated through Rockwell hardness test and 2 mm U-notch Charpy impact test, respectively. Furthermore, the ratios of average length/average diameter corresponding to circle of sulfides on the sections of steels were measured through a metallographic microscope. Obtained results were shown in Table 2.

TABLE 2

| Steel No. | Hardness (HRC) | 2 mm U-notch charpy impact value ($J/cm^2$) | Ratio of average length/ average diameter of sulfides |
|---|---|---|---|
| Invention sheets | | | |
| A | 44.2 | 30 | — |
| B | 45.8 | 36 | 1.26 |
| C | 46.5 | 42 | 1.44 |
| D | 43.4 | 24 | — |
| E | 44.5 | 31 | 1.85 |
| F | 43.2 | 36 | 2.34 |
| G | 44.2 | 18 | 2.18 |
| H | 45.2 | 12 | 1.85 |
| I | 46.5 | 42 | — |
| J | 46.5 | 42 | — |
| K | 46.1 | 24 | 1.32 |
| Comparative steels | | | |
| 1 | 40.8 | 14 | — |
| 2 | 42.5 | 21 | — |
| 3 | 46.8 | 23 | — |

Although the present invention has been described in detail concerning the examples, this invention is not limited to the above-mentioned examples, it is possible to practice the invention in various forms without deperting from the sprit and scope of this invention.

As mentioned above, according to this invention, it is possible to obtain the precipitation hardening steel which can be performed with uniform photoetching, possible to extend the life-time of the metallic mold for forming plastics and possible to realize the high-speed forming of plastics.

Furthermore, it is possible to obtain the steel which has the charpy impact value higher than a certain level, is excellent in the machinability and applicable to the metallic mold.

What is claimed is:

1. A high-hardness precipitation hardening steel for a metallic mold consisting essentially by weight percentage of from 0.05 to 0.18% of C, from 0.15 to 1.00% of Si, from 1.0 to 2.0% of Mn, from 2.5 to 3.5% of Ni, from 0.7 to 2.0% of Cr, from 0.5 to 1.5% of Al, from 0.7 to 1.7% of Cu, from 0.1 to 0.4% of Mo, from 0.05 to 0.35% of S, and the balance being Fe and inevitable impurities, and having hardness of not lower than HRC43 after aging treatment and impact value of not lower than 10 $J/cm^2$ by 2 mm U-notch charpy impact test, wherein H-value calculated using the following equation indicates zero or a positive value: $H=(3.843\ Mn+4.378\ Cr^{0.58})-(4.220S+8.193)$.

2. A high-hardness precipitation hardening steel for a metallic mold as set forth in claim 1, wherein the steel contains from 0.05 to 0.20% of S, and the impact value is not lower than 25 $J/cm^2$.

3. A high-hardness precipitation hardening steel for a metallic mold as set forth in claim 1, wherein a ratio of average length/average diameter corresponding to a circle of sulfides observed on a section of the steel is not lower than 1.7.

4. A high-hardness precipitation hardening steel for a metallic mold as set forth in claim 1, wherein the steel contains from 0.20 to 0.35% of S.

5. A high-hardness precipitation hardening steel for a metallic mold as set forth in claim 3, wherein the steel contains from 0.20 to 0.35% of S.

6. A high-hardness precipitation hardening steel for a metallic mold as set forth in claim 1, wherein said metallic mold is to be used for forming plastics required to surpass in specular gloss.

7. A high-hardness precipitation hardening steel for a metallic mold as set forth in claim 2, wherein said metallic mold is to be used for forming plastics required to surpass in specular gloss.

8. A high-hardness precipitation hardening steel for a metallic mold as set forth in claim 3, wherein said metallic mold is to be used for forming plastics required to surpass in specular gloss.

9. A high-hardness precipitation hardening steel for a metallic mold as set forth in claim 4, wherein said metallic mold is to be used for forming plastics required to surpass in specular gloss.

10. A high-hardness precipitation hardening steel for a metallic mold as set forth in claim 5, wherein said metallic mold is to be used for forming plastics required to surpass in specular gloss.

* * * * *